US011819972B1

(12) United States Patent
Hsieh

(10) Patent No.: US 11,819,972 B1
(45) Date of Patent: Nov. 21, 2023

(54) PNEUMATIC MACHINE TOOL

(71) Applicant: DIN LONG INDUSTRIAL CO., LTD., Taoyuan (TW)

(72) Inventor: Jung-Fu Hsieh, Taoyuan (TW)

(73) Assignee: DIN LONG INDUSTRIAL CO., LTD., Taoyuan (TW)

( * ) Notice: Subject to any disclaimer, the term of this patent is extended or adjusted under 35 U.S.C. 154(b) by 23 days.

(21) Appl. No.: 17/845,068

(22) Filed: Jun. 21, 2022

(51) Int. Cl.
*B24B 23/02* (2006.01)
*B25F 5/02* (2006.01)

(52) U.S. Cl.
CPC ..... *B24B 23/026* (2013.01); *B25F 5/02* (2013.01)

(58) Field of Classification Search
CPC ..... B25F 5/02; B24B 23/026
See application file for complete search history.

(56) References Cited

U.S. PATENT DOCUMENTS

2021/0205966 A1* 7/2021 Ho ..... B25B 23/0028

FOREIGN PATENT DOCUMENTS

| | | |
|---|---|---|
| TW | I711511 B | 12/2020 |
| TW | I724856 B | 4/2021 |
| TW | I724866 B | 4/2021 |

* cited by examiner

*Primary Examiner* — Daniel Jeremy Leeds
(74) *Attorney, Agent, or Firm* — MUNCY, GEISSLER, OLDS & LOWE, P.C.

(57) ABSTRACT

A pneumatic machine tool comprises a handle with one end being a first pivot connecting end, and a tool head. The handle comprises a main flow channel extending to the first pivot connecting end, and a switch assembly provided in the main flow channel. The tool head comprises a main body, a tool driving assembly disposed in the main body, and two pivot connecting arms formed on the main body and disposed side by side. The two pivot connecting arms are served as a second pivot connecting. The main body is formed with a chamber provided for disposing the tool driving assembly, and at least one secondary flow channel communicating with the chamber and extending to the two pivot connecting arms. The pivot shaft comprises a transfer flow channel and two transfer ports communicating with the channel.

15 Claims, 7 Drawing Sheets

PNEUMATIC MACHINE TOOL

FIELD OF THE INVENTION

The invention relates to a pneumatic machine tool and more particularly to a pneumatic machine tool with two pivot connecting arms disposing on a tool head.

BACKGROUND OF THE INVENTION

Existing hand-held pneumatic machine tools can be mainly divided into two parts, a tool head and a handle. The hand-held pneumatic machine tool is provided with a pneumatic motor inside the tool head, an air inlet channel is formed on the tool head and the handle, and external gas flows into the tool head along the air inlet channel to drive the pneumatic motor to run, so that the pneumatic motor drives the tool to work.

However, because the tool head and the handle of the conventional hand-held pneumatic machine tool cannot move relative to each other, the pneumatic machine tool is easily restricted by a width of the working environment or obstacles, and cannot be smoothly manipulated. In the past, the operator could only swing his wrist to change the manipulation angle to make the operation position of the tool match the surface to be machined, but this would easily affect the smoothness of operation and also cause occupational injury to the operator.

In order to solve the aforementioned problems, the manufacturers of pneumatic machine tools have acquired patents such as TW 1711511, TW 1724866 and TW 1724856. The aforementioned patents disclose that the tool head and the handle are connected by the pivot shaft, and the user can change the angle between the tool head and the handle by manipulating the pivot shaft, so that the tool head can swing relative to the handle according to different operation requirements. However, the tool heads of the pneumatic machine tools disclosed in TW 1711511 and TW 1724866 are assembled at a single point, that is, the assembly neck that is inserted between the two connecting arms of the handle is provided on the tool head. Because inside the tool head is provided with the pneumatic motor, and the pneumatic motor has to be connected to the tool when the pneumatic machine tool is to be operated, the assembly neck needs to bear the weights of the pneumatic motor and the tool, which will cause the assembly neck to be easily damaged after long-term use. Furthermore, in the conventional pneumatic machine tools, in the process of gas flowing from the main flow channel to the head, the gas enters the two branch flow channels from the main flow channel, and then enters the head. However, the design of the gas path easily affects the concentration of the gas flow, causing the gas flow rate to drop, and the motor incapable of being driven to work normally. In addition, the aforementioned pneumatic machine tools require a large number of additional sealing structures to establish the gas path, which leads to inconvenience in assembly. Furthermore, if the sealing structure loses the airtight function, it is easy to cause the gas flow rate inside the conventional pneumatic machine tool to be too low, resulting in the pneumatic machine tool being incapable of functioning properly.

SUMMARY OF THE INVENTION

A main object of the invention is to solve the problems caused by the deficient structures of the conventional pneumatic machine tool with an adjustable tool head.

In order to achieve the above object, the invention provides a pneumatic machine tool comprising a handle and a tool head, one end of the handle is a first pivot connecting end, and the handle comprises a main flow channel extending to reach the first pivot connecting end, and a switch assembly provided in the main flow channel. The switch assembly determines whether the main flow channel is in a ventilation state or a stopped ventilation state. The tool head comprises a main body, a tool driving assembly disposed in the main body, and two pivot connecting arms formed on the main body and disposed side by side. The two pivot connecting arms served as a second pivot connecting end of the tool head to be assembled with the first pivot connecting end through a pivot shaft. The main body is formed with a chamber provided for disposal of the tool driving assembly, and at least one secondary flow channel communicating with the chamber and extending to the two pivot connecting arms. The pivot shaft comprises a transfer flow channel and two transfer ports communicating with the transfer flow channel, and the main flow channel and the at least one secondary flow channel form a ventilation path through the two transfer ports.

In one embodiment, a plurality of choke rings are formed on the pivot shaft to establish the ventilation path together with the main flow channel and the at least one secondary flow channel.

In one embodiment, the pivot shaft comprises a head, and the head is served as one of the plurality of choke rings.

In one embodiment, the pivot shaft is provided with a plurality of airtight washers respectively located on the plurality of choke rings.

In one embodiment, the pivot shaft comprises a port communicating with the transfer flow channel, and wherein when the pivot shaft is pivotally connected to the handle and the tool head, the port is closed by one of the two pivot connecting arms.

In one embodiment, the handle comprises a first shaft mounting hole communicating with the main flow channel, and two second shaft mounting holes communicating with the first shaft mounting hole are formed on the two pivot connecting arms, respectively, and wherein the first shaft mounting hole and two second shaft mounting holes are provided for the pivot shaft to dispose therein.

In one embodiment, one of the two second shaft mounting holes is a through hole, and an other one of the two second shaft mounting holes is a blind hole.

In one embodiment, the main flow channel penetrates the first pivot connecting end, and the handle comprises a first plug mounted at the first pivot connecting end to close a first opening of the main flow channel located at the first pivot connecting end.

In one embodiment, the at least one secondary flow channel penetrates one of the two pivot connecting arms, and the tool head comprises a second plug mounted on one of the two pivot connecting arms which is penetrated by the at least one secondary flow channel to close a second opening of the at least one secondary flow channel.

In one embodiment, the handle comprises a body provided for disposal of the switch assembly, and a neck connecting with the body and served as the first pivot connecting end.

In one embodiment, the handle comprises a manipulation pressing plate disposed on the body for driving the switch assembly.

Accordingly, the invention has the following features: the invention is provided with the two pivot connecting arms, the tool head utilizes the two pivot connecting arms as the second pivot connecting end, and the tool head is connected with the first pivot connecting end through the pivot shaft to achieve an object of swinging relative to the handle. In addition, the invention forms the secondary flow channel extending to one of the two pivot connecting arms through the main body, so that gas can flow into the chamber more concentrated to prevent the pneumatic machine tool from being incapable of working properly caused by a low gas flow rate. Furthermore, through disposition of the pivot shaft and the transfer flow channel of the invention, the problem of the prior art that a large number of additional sealing structures are required to establish a ventilation path can be improved.

DETAILED DESCRIPTION OF THE PREFERRED EMBODIMENTS

The detailed description and technical content of the invention are described below with reference to the accompanying drawings.

Figure 1:
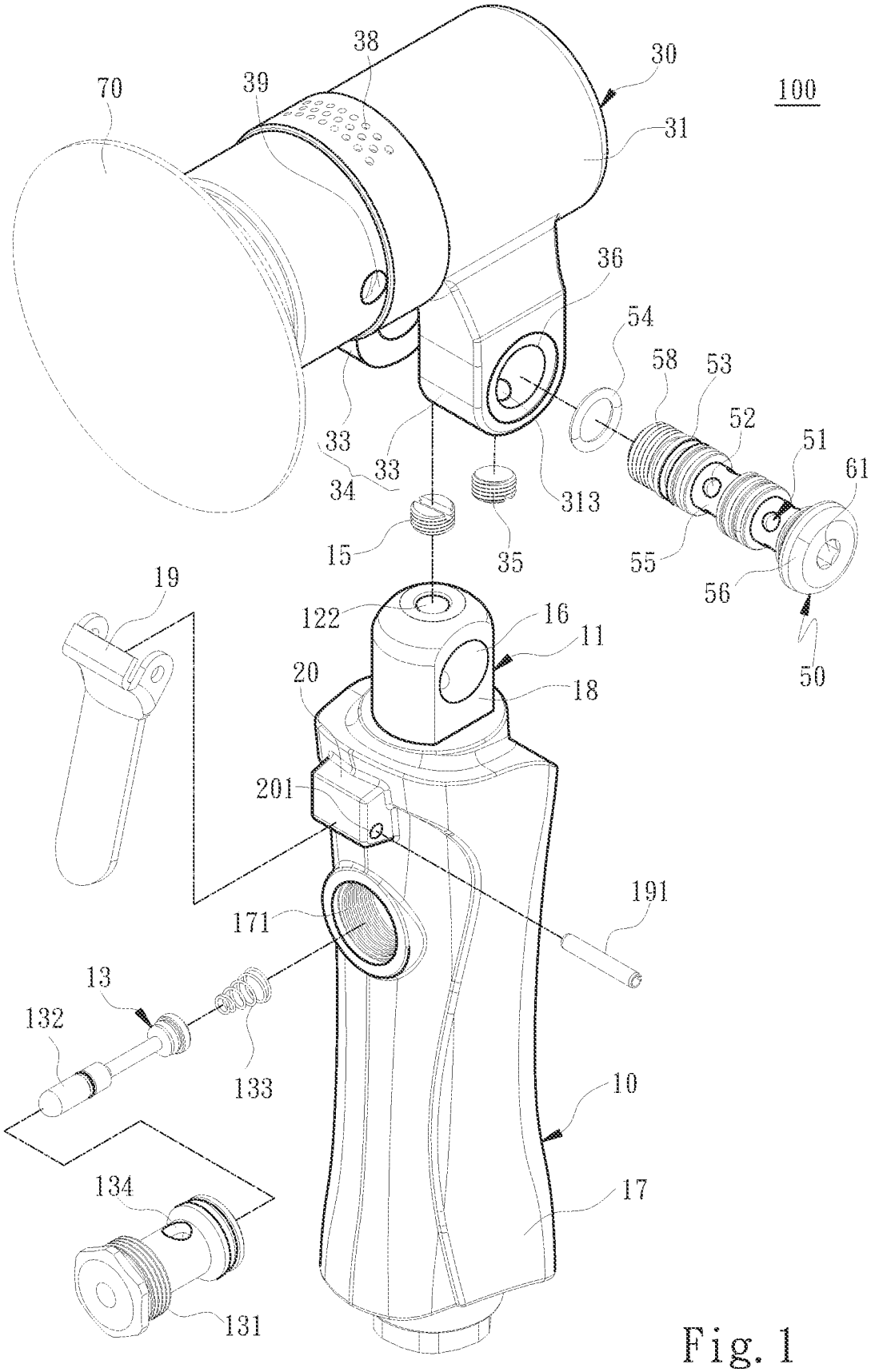
FIG. 1 is a first exploded perspective structural view of an embodiment of the invention.

Please refer to FIG. 1, the invention provides a pneumatic machine tool 100. The pneumatic machine tool 100 is used with a tool 70. According to types of the tool 70, the pneumatic machine tool 100 can be a pneumatic wrench, a pneumatic grinder or a pneumatic drill, etc. In other words, types and functions of the pneumatic machine tool 100 are not limited in the invention.

Please refer to FIG. 2, FIG. 3, FIG. 4, FIG. 5 and FIG. 6, the pneumatic machine tool 100 includes a handle 10 and a tool head 30. The handle 10 is provided for a user to hold thereon when operating the pneumatic machine tool 100. One end of the handle 10 is a first pivot connecting end 11, and the handle 10 includes a main flow channel 12 extending to the first pivot connecting end 11, and a switch assembly 13 disposed on the main flow channel 12, wherein the main flow channel 12 communicates with an air inlet 14 on the handle 10. The switch assembly 13 determines whether the main flow channel 12 is in a ventilation state or a stopped ventilation state after being operated by the user. The stopped ventilation state mentioned herein refers to the pneumatic machine tool 100 is not activated when the switch assembly 13 is not operated initially, so that the main flow channel 12 is not communicated and unable to output gas to the tool head 30; and the ventilation state mentioned herein refers to the pneumatic machine tool 100 is activated when the switch assembly 13 is operated, so that the main flow channel 12 is communicated to receive gas from the air inlet 14 and output gas to the tool head 30, thereby the pneumatic machine tool 100 is capable of driving the tool 70 to work.

Figure 7:
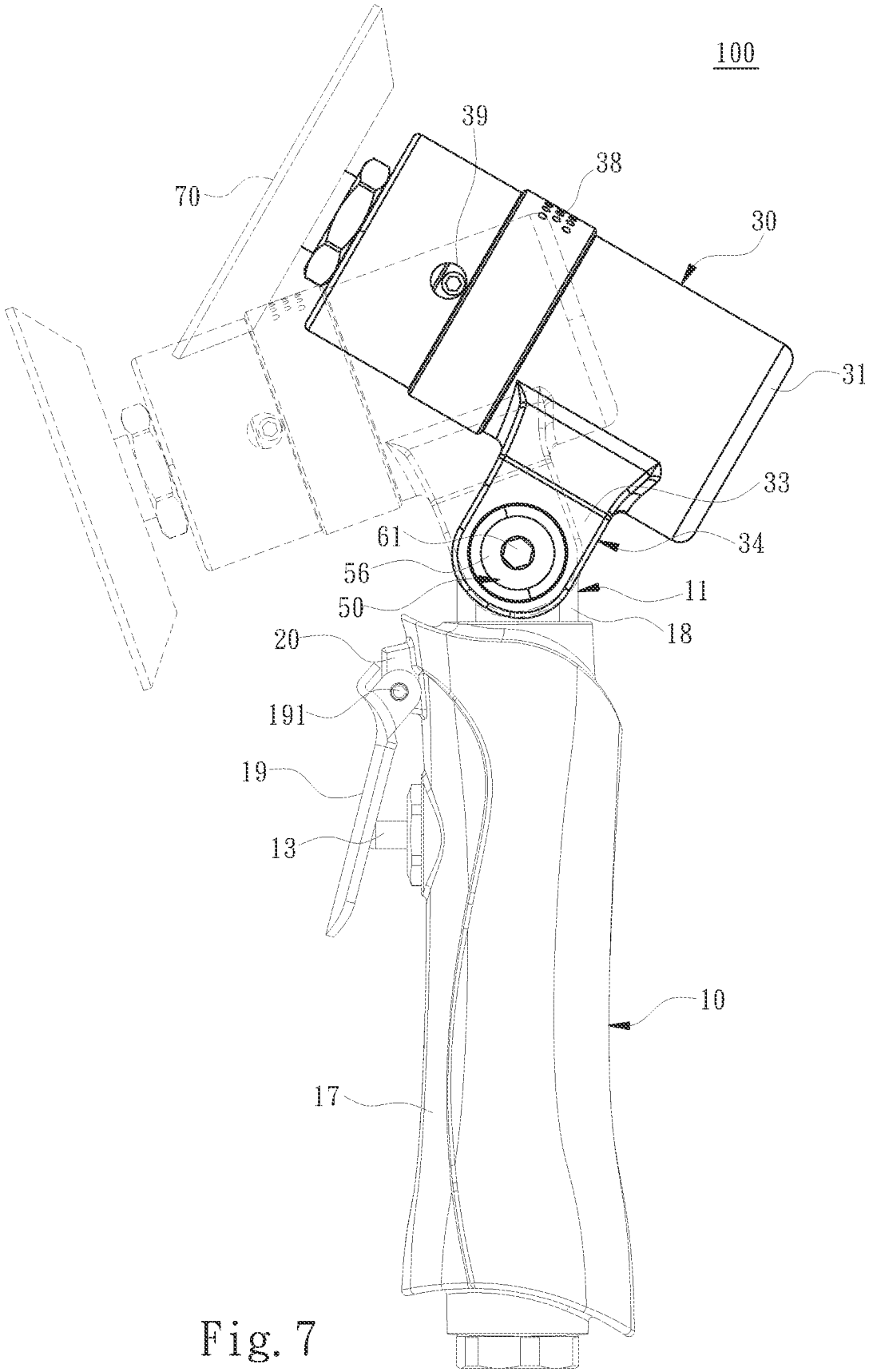
FIG. 7 is a schematic diagram of a tool head swinging according to an embodiment of the invention.

The tool head 30 includes a main body 31, a tool driving assembly 32 disposed in the main body 31, and two pivot connecting arms 33 formed on the main body 31, wherein the two pivot connecting arms 33 are disposed side by side on a side of the main body 31, when the tool head 30 is to be pivotally connected with the handle 10, the tool head 30 provides a second pivot connecting end 34 via the two pivot connecting arms 33, the second pivot connecting end 34 of the tool head 30 is assembled with the first pivot connecting end 11 through a pivot shaft 50, and the tool head 30 is capable of achieving an object of swinging relative to the handle 10 through the pivot shaft 50, as shown in FIG. 7. The tool driving assembly 32 is used to drive the tool 70. In one embodiment, the tool driving assembly 32 comprises a pneumatic motor 321 and a working shaft 322 (shown in FIG. 7) disposed on the pneumatic motor 321. The working shaft 322 is assembled with the tool 70, the working shaft 322 is driven when the pneumatic motor 321 is running, and the working shaft 322 drives the tool 70 to move. In addition, the main body 31 is formed with a chamber 311 provided for disposing of the tool driving assembly 32, and at least one secondary flow channel 312 communicating with the chamber 311. The chamber 311 is formed by a single component or a plurality of components. The chamber 311 is provided for gas to flow therein to drive the tool driving assembly 32. The at least one secondary flow channel 312 extends from the chamber 311 to one of the two pivot connecting arms 33, the at least one secondary flow channel 312 has functions of receiving and guiding gas, and the at least one secondary flow channel 312 receives gas entering into the tool head 30 and guides gas to flow into the chamber 311. In addition, the pivot shaft 50 includes a transfer flow channel 51 and two transfer ports 52 communicating with the transfer flow channel 51. The two transfer ports 52 are respectively communicated with the main flow channel 12 and the at least one secondary flow channel 312. The transfer flow channel 51 communicates with the main flow channel 12 and the at least one secondary flow channel 312 through the two transfer ports 52. In other words, the transfer flow channel 51 has a function of communicating the main flow channel 12 with the at least one secondary flow channel 312, so that the main flow channel 12 and the at least one secondary flow channel 312 form a ventilation path 101.

Implementation of the pneumatic machine tool 100 will be described hereinafter, please refer to FIG. 4 and FIG. 5. It is assumed that initially the pneumatic machine tool 100 and the switch assembly 13 are not in operation, so that there is no gas flow in the main flow channel 12. Once the switch assembly 13 is operated, the switch assembly 13 changes a state of the main flow channel 12 to receive gas from the air inlet 14 and supply gas to the tool head 30. Gas in the main flow channel 12 enters the transfer flow channel 51 through one of the two transfer ports 52, and then flows out of the transfer flow channel 51 through the other one of the two transfer ports 52 to enter the at least one secondary flow channel 312. That is to say, after the switch assembly 13 is operated, gas in the main flow channel 12 will flow into the at least one secondary flow channel 312 along the ventilation path 101, and then flow into the chamber 311 to drive the tool driving assembly 32. In addition, when the pneumatic machine tool 100 is to be stopped from operating, the switch assembly 13 stops being operated, gas in the main flow channel 12 stops flowing, and gas stops flowing on the ventilation path 101. At this moment, there is no gas entering into the chamber 311, and the tool driving assembly 32 can no longer be driven, so that the tool 70 stops being driven.

It can be known from the above that, in the invention, through disposition of the two pivot connecting arms 33, when the tool head 30 is to be assembled with the handle 10, the tool head 30 is assembled with the pivot shaft 50 through the two pivot connecting arms 33, and is pivotally connected on the handle 10 to achieve an object of assembling and swinging. In addition, the main body 31 of the invention forms the at least one secondary flow channel 312 extending to one of the two pivot connecting arms 33, so that gas can flow into the chamber 311 centrally in order to prevent a gas flow rate from being too low to cause the pneumatic machine tool 100 being incapable of working properly. Furthermore, through disposition of the two pivot connecting arms 33 and the pivot shaft 50 of the invention, the problem of prior arts that a large number of additional sealing structures are required to establish a ventilation path can be improved. In this way, the invention is capable of avoiding the problem of leaking of gas flow in the prior arts due to aging of sealing structures or unreliable assembly, resulting in the problems of the gas flow rate being too low in the conventional pneumatic machine tool and the conventional pneumatic machine tool being incapable of working properly.

Figure 3:
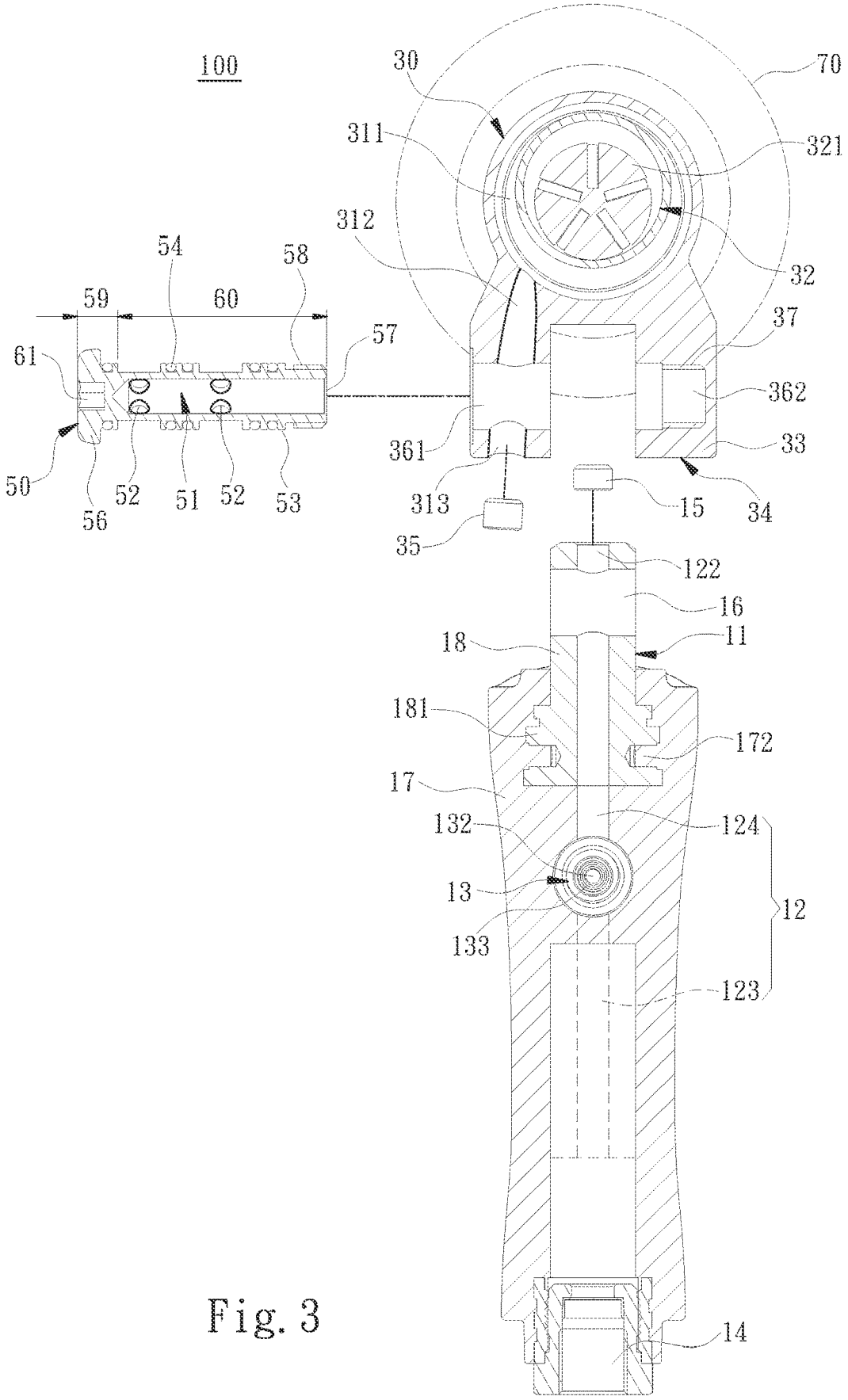
FIG. 3 is an exploded cross-sectional structural view of an embodiment of the invention.
Figure 4:
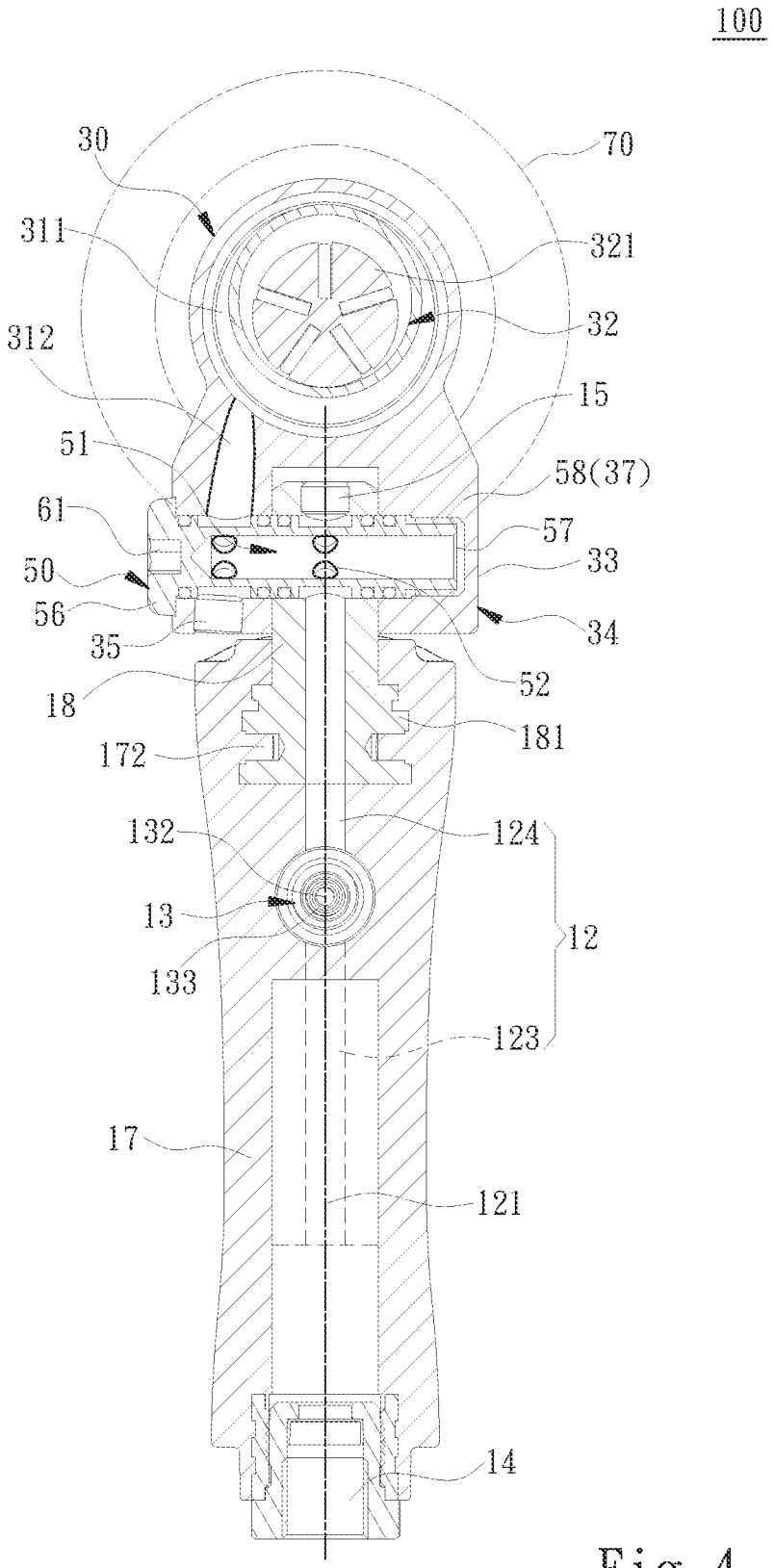
FIG. 4 is a cross-sectional structural view of an embodiment of the invention.
Figure 5:
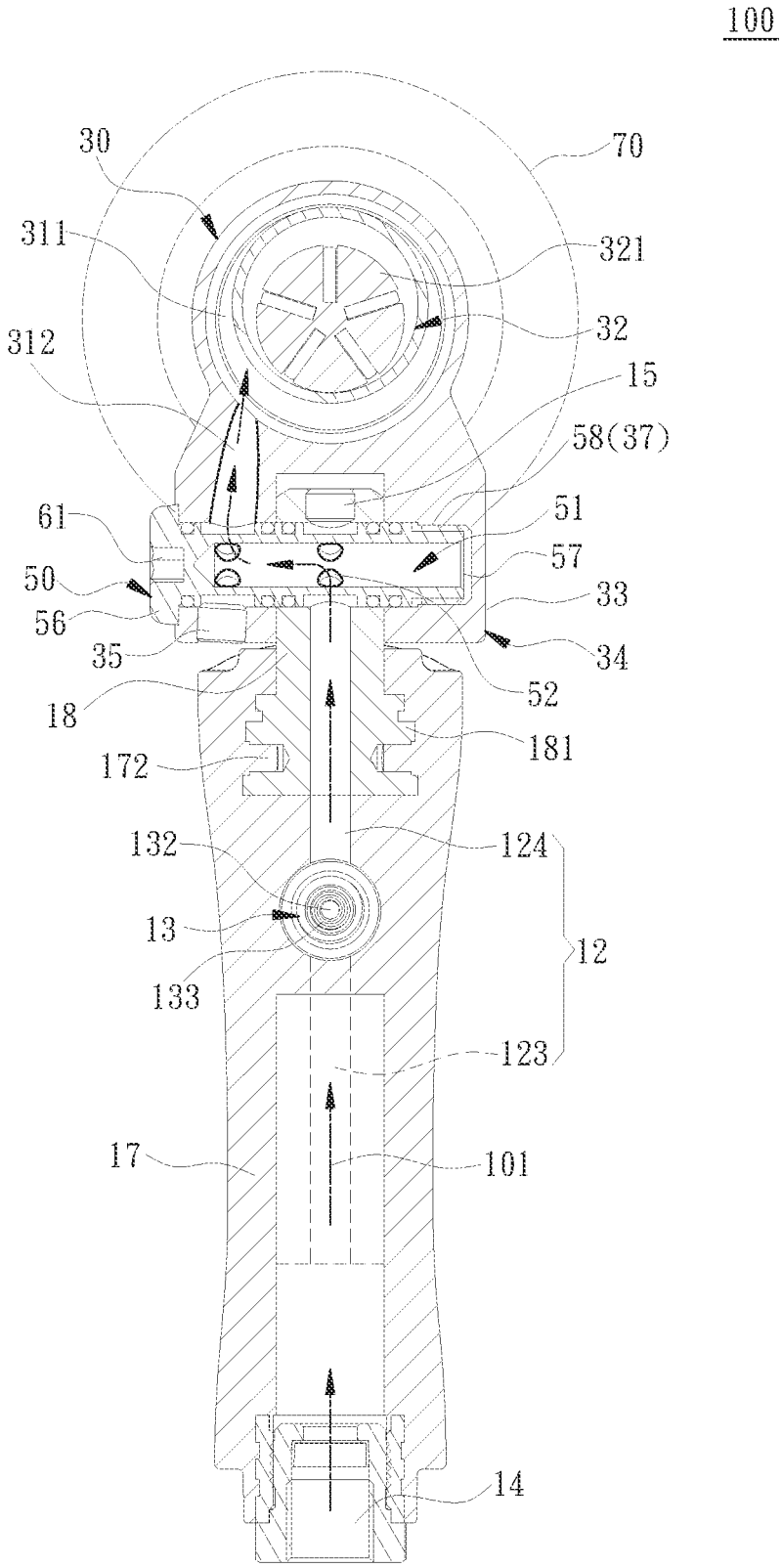
FIG. 5 is a cross-sectional view of implementation of an embodiment of the invention.
Figure 6:
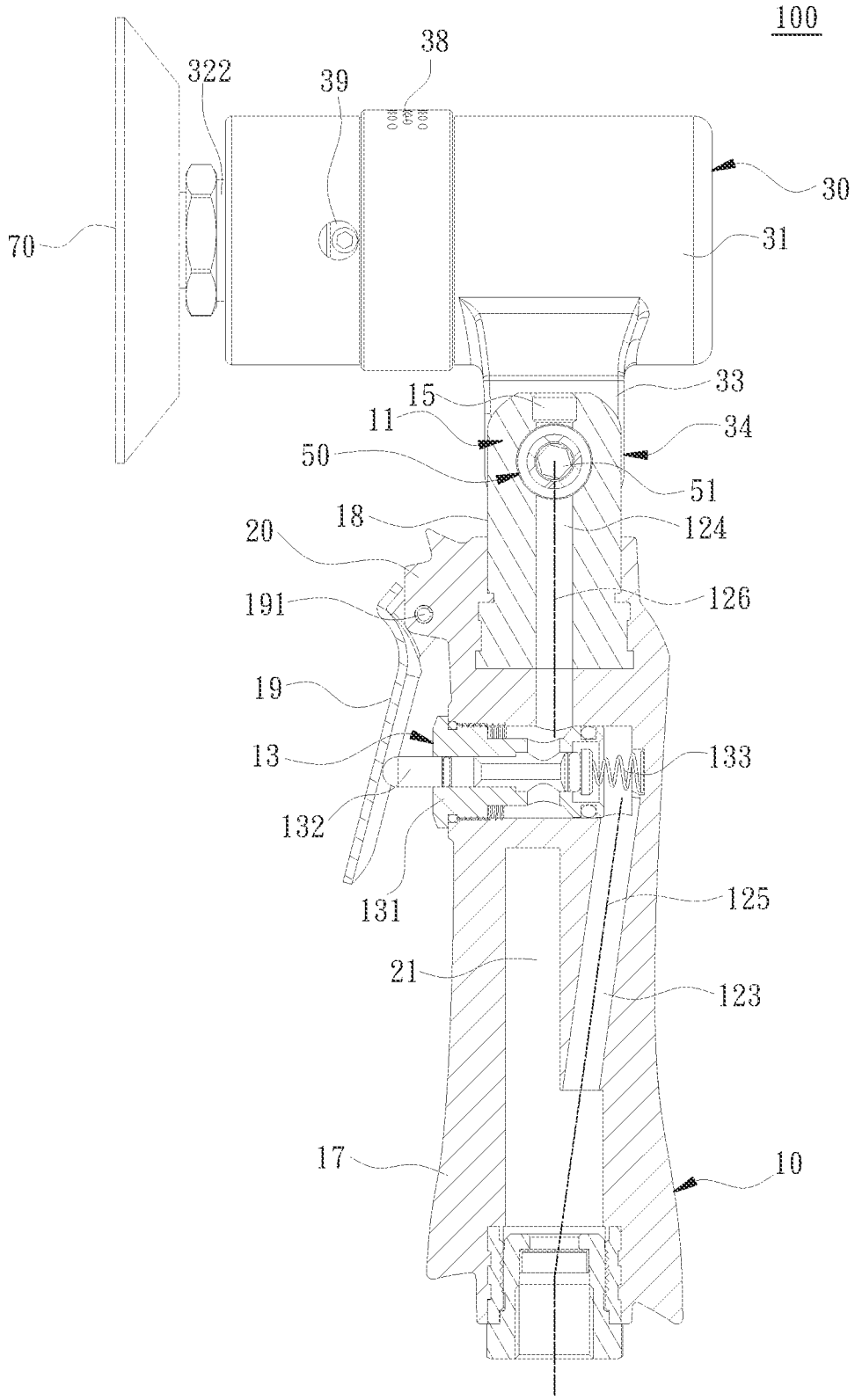
FIG. 6 is a cross-sectional structural view of an embodiment of the invention.

Please refer to FIG. 3, FIG. 4, and FIG. 5, a plurality of choke rings 53 are formed on the pivot shaft 50, and the plurality of choke rings 53 are located between the first pivot connecting end 11 and the second pivot connecting end 34. The plurality of choke rings 53 restrict gas flowing into the at least one secondary flow channel 312 only from the main flow channel 12 through the transfer flow channel 51. In other words, the plurality of choke rings 53 mainly provide a function for blocking gas from leaking to define the transfer flow channel 51, so as to establish the ventilation path 101 together with the main flow channel 12 and the at least one secondary flow channel 312. In one embodiment, the plurality of choke rings 53 are disposed at intervals, the plurality of choke rings 53 are located on two sides of each of the two transfer ports 52, and positions of the plurality of choke rings 53 do not overlap with positions of the two transfer ports 52. In addition, in one embodiment, the pivot shaft 50 of the invention is provided with a plurality of airtight washers 54 thereon, wherein the plurality of airtight washers 54 are located on the plurality of air choke rings 53, and the plurality of airtight washers 54 provide an airtight function and assist the plurality of choke rings 53 in establishing the ventilation path 101 together with the main flow channel 12 and the at least one secondary flow channel 312.

Please refer to FIG. 2, FIG. 3, FIG. 4 and FIG. 5, the pivot shaft 50 includes a rod body 55 and a head 56 located at one end of the rod body 55. The head 56 is served as one of the plurality of choke rings 53 to block communication between an outside and the transfer flow channel 51, and the head 56 restricts gas to only flow into the at least one secondary flow channel 312 after entering the transfer flow channel 51. That is, by utilizing the head 56 as one of the plurality of choke rings 53, the transfer flow channel 51 is formed inside the rod body 55 of the pivot shaft 50.

In one embodiment, an end of the rod body 55 without including the head 56 is open, and the pivot shaft 50 includes a port 57 communicating with the transfer flow channel 51. When the pivot shaft 50 is pivotally connected to the handle 10 and the tool head 30, the port 57 is closed by one of the two pivot connecting arms 33, and one of the two pivot connecting arms 33 closing the port 57 restricts a flow direction of gas in the transfer flow channel 51.

Figure 2:
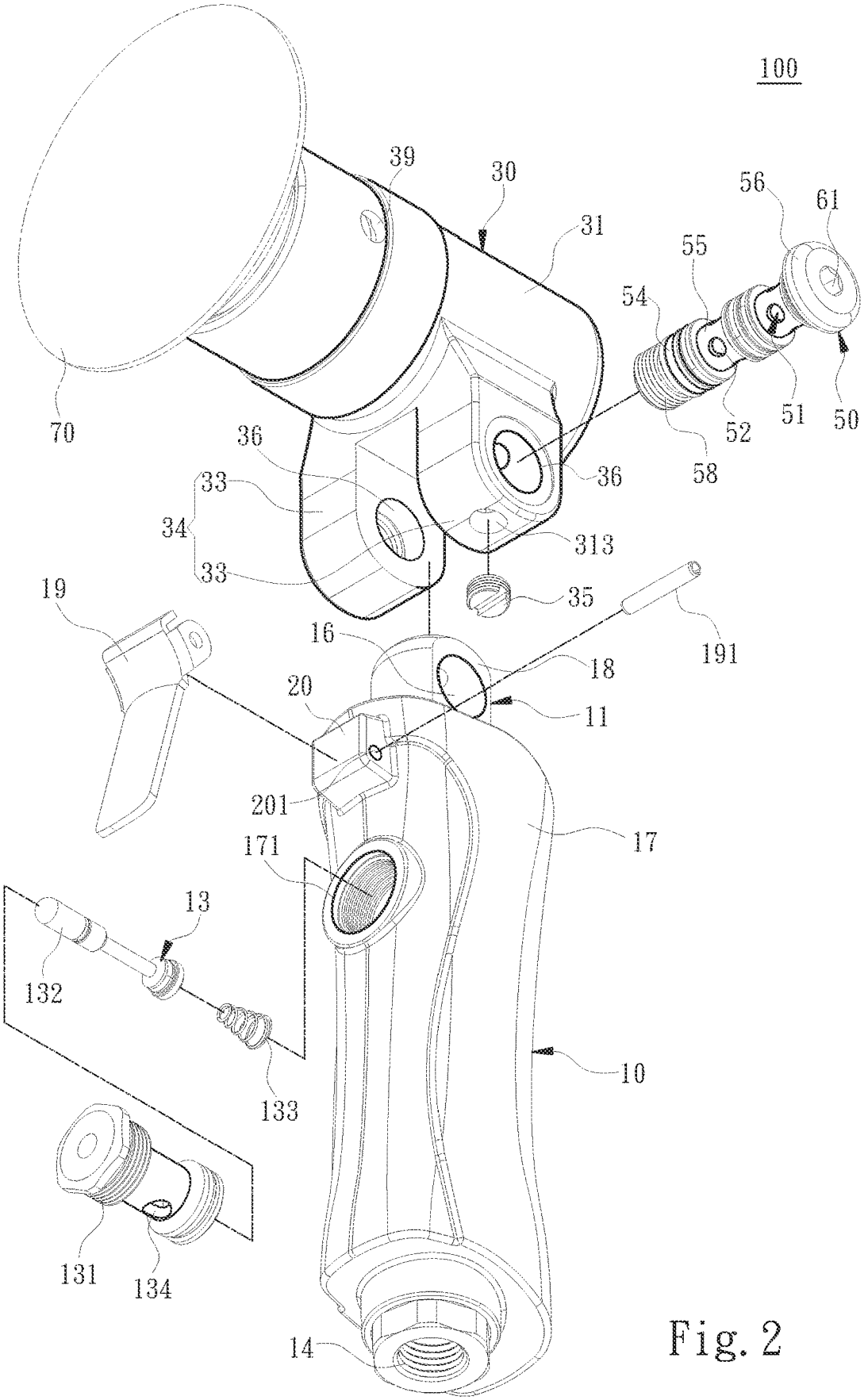
FIG. 2 is a second exploded perspective structural view of an embodiment of the invention.

For more details, please refer to FIG. 2 and FIG. 3, the handle 10 includes a first shaft mounting hole 16 communicating with the main flow channel 12, and each of the two pivot connecting arms 33 forms a second shaft mounting hole 36. Two second shaft mounting holes 36 communicate with the first shaft mounting hole 16 side by side and are respectively located on two sides of the first shaft mounting hole 16, and the two second shaft mounting holes 36 and the first shaft mounting hole 16 are provided for the pivot shaft to dispose therein. In one embodiment, the first shaft mounting hole 16 and one of the two second shaft mounting holes 36 are through holes, and the other one of the two second shaft mounting holes 36 is a blind hole. The first shaft mounting hole 16 and one of the two second shaft mounting holes 36 being the through hole (as indicated by a reference numeral 361) are provided for the pivot shaft 50 to insert therein, and the other one of the two second shaft mounting holes 36 being the blind hole (as indicated by the reference numeral 362) is utilized to close the port 57 of the pivot shaft 50 to restrict a flow direction of gas in the transfer flow channel 51. Accordingly, compared with the prior arts, the invention does not need to rely on a large number of sealing structures to establish the ventilation path 101, and is capable of reducing problems caused when the sealing structures are incapable of providing an airtight function.

On the other hand, please refer to FIG. 3, FIG. 4 and FIG. 5 to observe the pivot shaft 50 from a top view. The two transfer ports 52 are located at different positions of the pivot shaft 50, respectively. In detail, one of the two transfer ports 52 faces the main flow channel 12, and the other of the two transfer ports 52 faces the at least one secondary flow channel 312. The handle 10 includes an extension line 121 based on an extending direction of the main flow channel 12, one of the two transfer ports 52 facing the main flow channel 12 is located on the extension line 121, and the other one of the two transfer ports 52 facing the at least one secondary flow channel 312 is not located on the extension line 121. In other words, the main flow channel 12 and the at least one secondary flow channel 312 are not coaxially disposed, and the ventilation path 101 has turns.

Further, please refer to FIG. 3, FIG. 4 and FIG. 5, when the main flow channel 12 penetrates the first pivot connecting end 11, the main flow channel 12 includes a first opening 122 located at the first pivot connecting end 11, the handle 10 includes a first plug 15 mounted at the first pivot connecting end 11, and the first plug 15 is utilized to close the first opening 122 of the main flow channel 12, so that the main flow channel 12 only provides gas to flow in one direction. In addition, in another embodiment, when the at least one secondary flow channel 312 penetrates one of the two pivot connecting arms 33, the at least one secondary flow channel 312 includes a second opening 313 located at the second pivot connecting end 34, the tool head 30 includes a second plug 35 mounted on one of the two pivot connecting arm 33 penetrated by the at least one secondary flow channel 312, and the second plug 35 is utilized to close the second opening 313 of the at least one secondary flow channel 312, so that the at least one secondary flow channel 312 only provides gas to flow in one direction.

Furthermore, in another embodiment, at least one of the two pivot connecting arms 33 includes a first threaded portion 37 disposed on an inner wall of the second shaft mounting hole 36 corresponded, and the pivot shaft 50 includes a second threaded portion 58 matched with the first threaded portion 37. When the pivot shaft 50 is pivotally connected to the handle 10 and the tool head 30, the second threaded portion 58 is assembled with the first threaded portion 37. In order to assist in assembling the pivot shaft 50, the pivot shaft 50 is divided into a wide-diameter section 59 and a narrow-diameter section 60 connecting with the wide-diameter section 59, wherein the wide-diameter section 59 is provided with the head 56, which is convenient for the user to hold thereon during assembly. In addition, the pivot shaft 50 includes an assembly hole 61 disposed on the head 56. The assembly hole 61 provides the user to pivotally connect the pivot shaft 50 on the handle 10 and the tool head 30 by using an external tool (such as a screwdriver, a hexagonal wrench, etc.).

On the other hand, please refer to FIG. 2, FIG. 3 and FIG. 6 again, the handle 10 includes a body 17 provided for disposal of the switch assembly 13, and a neck 18 connecting with the body 17, the neck 18 serves as the first pivot connecting end 11 of the handle 10, and the neck 18 is narrower than the body 17 for inserting between the two pivot connecting arms 33. In addition, in one embodiment, the body 17 and the neck 18 are formed in an integrally structure. In other embodiment, the body 17 and the neck 18 are formed in two independent components, wherein the neck 18 is formed with an assembly structure 181 assembled with the body 17 so that the body 17 and the neck 18 jointly form the main flow channel 12. In addition, in order to prevent the body 17 from being separated from the neck 18, the body 17 is formed with at least one positioning post 172 assembled with the neck 18. In addition, the body 17 is formed with an accommodating hole 171 in which the switch assembly 13 is disposed. The accommodating hole 171 communicates with the main flow channel 12, so that the switch assembly 13 determines whether the main flow channel 12 is communicated after being operated.

The handle 10 of the invention includes a manipulation pressing plate 19 disposed on the body 17, and the manipulation pressing plate 19 is operated by the user and utilized to drive the switch assembly 13. In addition, the switch assembly 13 comprises a diversion valve 131, a movable plug 132 disposed in the diversion valve 131, and a spring 133 butting against the movable plug 132. The diversion valve 131 includes a diversion flow channel 134; and the movable plug 132 is controlled by the manipulation pressing plate 19, and is butted by the spring 133 to close the diversion flow channel 134 under normal circumstances. That is to say, the movable plug 132 blocks a communication between the diversion flow channel 134 and the main flow channel 12 when the manipulation pressing plate 19 does not control the movable plug 132, so that gas in the main flow channel 12 cannot flow into the transfer flow channel 51. When the manipulation pressing plate 19 presses the movable plug 132, the movable plug 132 releases the diversion flow channel 134, so that the diversion valve 131 communicates with the main flow channel 12, and gas in the main flow channel 12 can flow into the transfer flow channel 51. In one embodiment, the handle 10 of the invention is formed with an assembly protrusion 20 disposed on the body 17 and provided for assembling the manipulation pressing plate 19, the assembly protrusion 20 is formed with an opening 201, and the opening 201 is provided for disposal of an assembling rod 191 of the manipulation pressing plate 19 so that the manipulation pressing plate 19 is capable of displacing relative to the switch assembly 13 after being assembled on the assembly protrusion 20.

In another embodiment, the main flow channel 12 is divided by the switch assembly 13 into an air inlet section 123 with the air inlet 14, and an air outlet section 124 located on a side close to the transfer flow channel 51. The diversion flow channel 134 of the diversion valve 131 communicates with the air inlet section 123 and the air outlet section 124. When the movable plug 132 closes the diversion flow channel 134, the air inlet section 123 cannot communicate with the air outlet section 124, and vice versa, the air inlet section 123 is able to communicate with the air outlet section 124. In addition, when viewing the pneumatic machine tool 100 from a side view, an extension line 125 of the air inlet section 123 and an extension line 126 of the air outlet section 124 intersect at one point. In another embodiment, the handle 10 is formed with a space 21 communicating with the main flow channel 12, and a main function of the space 21 is to provide the handle 10 with a light weight. It should be understood that an end of the space 21 without facing the air inlet 14 is not communicated with the at least one secondary flow channel 312, and the space 21 does not substitute for the main flow channel 12 to deliver gas.

In addition, in this embodiment, the tool head 30 includes at least one exhaust port 38 disposed on the main body 31, the exhaust port 38 communicates with the chamber 311 and the outside to discharge gas inside the chamber 311. In another embodiment, the tool head 30 of the invention includes at least one maintenance opening 39 formed on the main body 31, and the maintenance opening 39 has a function of facilitating disassembly of the main body 31 for maintenance of the tool driving assembly 32.

What is claimed is:

1. A pneumatic machine tool comprising:

a handle with one end being a first pivot connecting end, the handle comprising a main flow channel extending to the first pivot connecting end, and a switch assembly provided in the main flow channel, wherein the switch assembly determines whether the main flow channel is in a ventilation state or a stopped ventilation state; and a tool head, comprising a main body, a tool driving assembly disposed in the main body, and two pivot connecting arms formed on the main body and disposed side by side, wherein the two pivot connecting arms served as a second pivot connecting end of the tool head to be assembled with the first pivot connecting end through a pivot shaft, wherein the main body is formed with a chamber provided for disposal of the tool driving assembly, and at least one secondary flow channel communicating with the chamber and extending to the two pivot connecting arms;

wherein the pivot shaft comprises a transfer flow channel and two transfer ports communicating with the transfer flow channel, and the main flow channel and the at least one secondary flow channel form a ventilation path through the two transfer ports.

2. The pneumatic machine tool as claimed in claim 1, wherein a plurality of choke rings are formed on the pivot shaft to establish the ventilation path together with the main flow channel and the at least one secondary flow channel.

3. The pneumatic machine tool as claimed in claim 2, wherein the pivot shaft comprises a head, and the head is served as one of the plurality of choke rings.

4. The pneumatic machine tool as claimed in claim 2, wherein the pivot shaft is provided with a plurality of airtight washers respectively located on the plurality of choke rings.

5. The pneumatic machine tool as claimed in claim 1, wherein the pivot shaft comprises a port communicating with the transfer flow channel, and wherein when the pivot shaft is pivotally connected to the handle and the tool head, the port is closed by one of the two pivot connecting arms.

6. The pneumatic machine tool as claimed in claim 5, wherein the handle comprises a first shaft mounting hole communicating with the main flow channel, and two second shaft mounting holes communicating with the first shaft mounting hole are formed on the two pivot connecting arms, respectively, and wherein the first shaft mounting hole and two second shaft mounting holes are provided for the pivot shaft to dispose therein.

7. The pneumatic machine tool as claimed in claim 6, wherein one of the two second shaft mounting holes is a through hole, and an other one of the two second shaft mounting holes is a blind hole.

8. The pneumatic machine tool as claimed in claim 5, wherein the main flow channel penetrates the first pivot connecting end, and the handle comprises a first plug mounted at the first pivot connecting end to close a first opening of the main flow channel located at the first pivot connecting end.

9. The pneumatic machine tool as claimed in claim 8, wherein the at least one secondary flow channel penetrates one of the two pivot connecting arms, and the tool head comprises a second plug mounted on one of the two pivot connecting arms which is penetrated by the at least one secondary flow channel to close a second opening of the at least one secondary flow channel.

10. The pneumatic machine tool as claimed in claim 1, wherein the handle comprises a body provided for disposal of the switch assembly, and a neck connecting with the body and served as the first pivot connecting end.

11. The pneumatic machine tool as claimed in claim 10, wherein the handle comprises a manipulation pressing plate disposed on the body for driving the switch assembly.

12. The pneumatic machine tool as claimed in claim 10, wherein the handle comprises a first shaft mounting hole communicating with the main flow channel, and two second shaft mounting holes communicating with the first shaft mounting hole are formed on the two pivot connecting arms, respectively, and wherein the first shaft mounting hole and two second shaft mounting holes are provided for the pivot shaft to dispose therein.

13. The pneumatic machine tool as claimed in claim 12, wherein one of the two second shaft mounting holes is a through hole, and an other one of the two second shaft mounting holes is a blind hole.

14. The pneumatic machine tool as claimed in claim 1, wherein the main flow channel penetrates the first pivot connecting end, and the handle comprises a first plug mounted at the first pivot connecting end to close a first opening of the main flow channel located at the first pivot connecting end.

15. The pneumatic machine tool as claimed in claim 1, wherein the secondary flow channel penetrates one of the two pivot connecting arms, and the tool head comprises a second plug mounted on one of the two pivot connecting arms which is penetrated by the at least one secondary flow channel to close a second opening of the at least one secondary flow channel.

* * * * *